United States Patent [19]

Moen

[11] 4,207,996

[45] Jun. 17, 1980

[54] CONTAINER INCLUDING A HINGED FLAP VALVE ASSEMBLY

[76] Inventor: George A. Moen, 827 W. 26th Ave., Anchorage, Ak. 99503

[21] Appl. No.: 1,393

[22] Filed: Jan. 5, 1979

[51] Int. Cl.[2] ..... B67D 3/00

[52] U.S. Cl. ..... 222/507; 222/513; 222/528

[58] Field of Search ..... 222/507, 513, 516, 517, 222/527-531, 536-538, 553, 562

[56] References Cited

U.S. PATENT DOCUMENTS

| | | | |
|---|---|---|---|
| 3,198,406 | 8/1965 | Kopelman | 222/553 X |
| 3,278,095 | 10/1966 | Johns | 222/507 |
| 3,294,293 | 12/1966 | Johns | 222/507 |
| 3,371,827 | 3/1968 | Micauef | 222/507 |
| 3,860,151 | 1/1975 | Moen | 222/513 |

*Primary Examiner*—Joseph J. Rolla
*Assistant Examiner*—Fred A. Silverberg
*Attorney, Agent, or Firm*—Lawrence E. Laubscher

[57] ABSTRACT

An improved dispensing assembly is disclosed for dispensing liquids, powders, and the like from a container, including a container member having a body portion, a reduced neck portion, and an enlarged head portion, which enlarged head portion contains a first pouring opening, and a hinged flap moveable between open and closed positions relative to the first pouring opening. A dispensing closure member is rotatably mounted concentrically about the enlarged head portion, which closure member contains a second pouring opening and is rotatable between closed and open positions in which the pouring openings are out of and in alignment, respectively.

5 Claims, 5 Drawing Figures

CONTAINER INCLUDING A HINGED FLAP VALVE ASSEMBLY

BACKGROUND OF THE INVENTION

A. Field of the Invention

The present invention relates generally to a dispensing assembly for a synthetic plastic container member having an axially rotatable snap-fit synthetic plastic closure member mounted thereon.

B. Brief Description of the Prior Art

Synthetic plastic closure devices for dispensing liquids from a container which include a flexible hinged flap for closing a pouring opening are known in the art, as evidenced by the applicant's prior U.S. Pat. No. 3,860,151, which discloses a dispensing closure device adapted for mounting on a bottle.

Axially rotatable dispensing closures for closing one end of a container are also known in the art, as evidenced by the patents to Johns U.S. Pat. Nos. 3,278,095 and 3,294,293 and Micallef U.S. Pat. No. 3,371,827. These containers include a body member, an axially rotatable closure member mounted thereon, and a pouring spout which is operable between open and closed positions by rotation of the closure member.

SUMMARY OF THE INVENTION

The present invention relates to a synthetic plastic dispensing container for dispensing liquids, such as liquid laundry detergents, powders and the like. The dispensing assembly includes a container member having a body portion, a reduced neck portion, and an enlarged head portion which contains a first pouring opening and a hinged flap moveable between open and closed positions relative to the pouring opening. An axially rotatable dispensing closure member which contains a second pouring opening is mounted on the enlarged head and is rotatable from a closed position in which the two pouring openings are out of alignment, to an open position in which the two pouring openings are in alignment, whereby dispensing of the container contents may be effected.

The container member is preferably molded in one piece from a suitable synthetic plastic material, such as polyethylene. After formation of the container member, it is filled, the hinged flap is closed and sealed (for example, by placing a piece of tape over the flap, by heat shrinking a plastic film over the enlarged head, or by any other suitable means which will hold the flap in a closed position). The container member may then be transported or stored until ready for use. After the sealing means is removed, the closure member is snap-fit over the enlarged head by hand or by conventional capping machinery.

It is therefore a primary object of the present invention to provide a simple, inexpensive and efficient synthetic plastic dispensing container which includes a container member, and a dispensing closure member rotatably mounted concentrically thereon.

It is another object of the present invention to provide a dispensing container which may be shipped or stored without the dispensing closure member in place.

It is a further object of the present invention to provide a dispensing container wherein the dispensing closure member may be easily snap-fit thereon.

BRIEF DESCRIPTION OF THE DRAWING

Other objects and advantages of the invention will become apparent from a study of the following specification when viewed in light of the accompanying drawing, in which.

DETAILED DESCRIPTION

Figure 1:
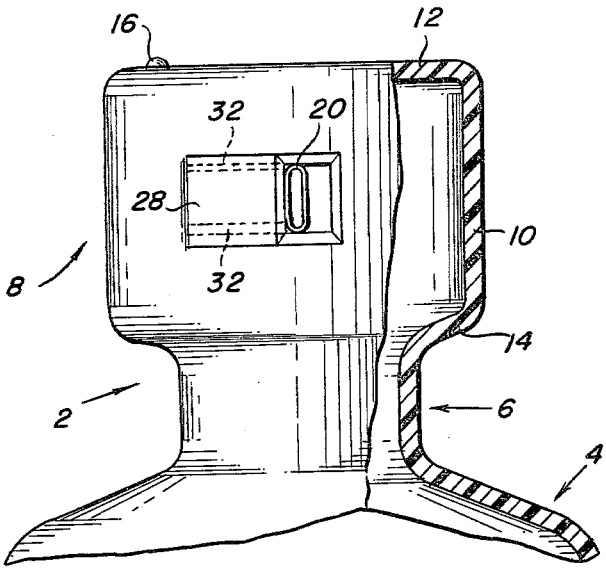
FIG. 1 is a partially broken away side elevational view of the container member of the present invention.
Figure 5:
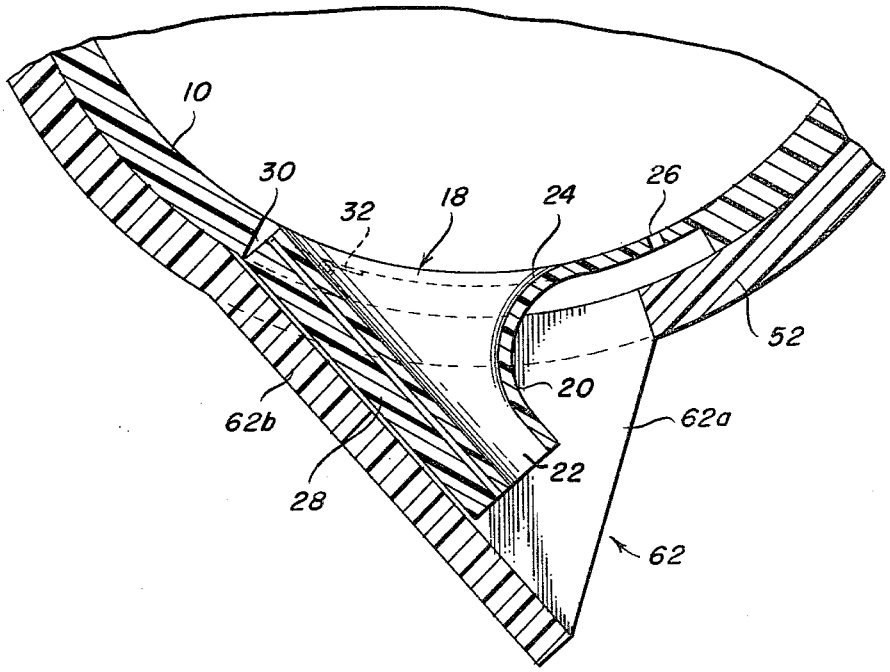
FIG. 5 is a detailed sectional view of the apparatus of FIG. 4.

Referring first to FIG. 1, the container member 2 includes a hollow body portion 4, a generally tubular reduced neck portion 6 connected with the upper end of the body portion, and an enlarged head portion 8 connected with the upper end of the neck portion 6. The enlarged head portion 8 includes a generally tubular side wall 10, a generally disk-shaped top wall 12 connected across the upper end of the side wall 10, and an annular ledge 14 connecting the lower end of the side wall 10 with the reduced neck 6. The top wall 12 further includes a projection 16, the purpose of which will be described hereinafter. As shown in greater detail in FIG 5, the side wall 10 includes a pouring opening 18, a flexible pouring spout 20 having an outlet opening 22, a lip portion 24 having an air vent hole 26 adjacent said pouring opening, a hinged flap 28 connected with the side wall 10 by a reduced portion 30, and spring means 32 normally biasing the flap 28 outwardly toward an open position.

Figure 2:
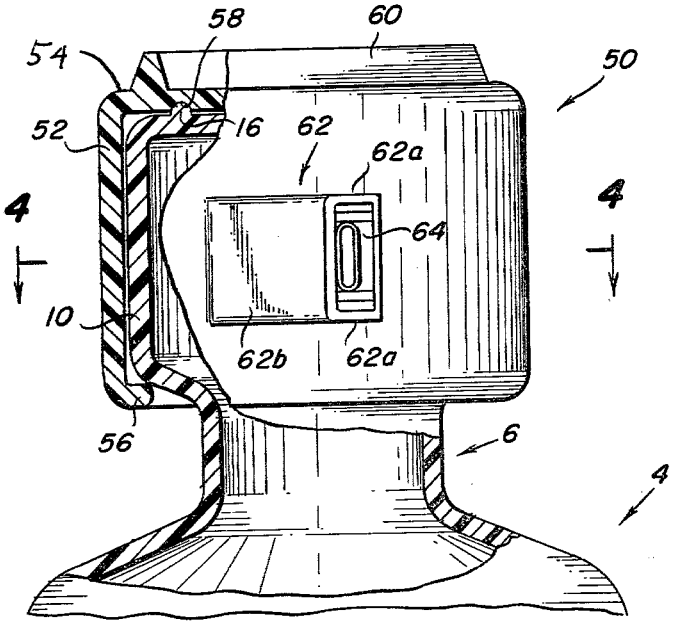
FIG. 2 is a partially broken away side elevational view of the container of FIG. 1 with the dispensing closure member mounted thereon.

Referring now to FIG. 2, an axially rotatable dispensing closure member 50 is mounted concentrically about the enlarged head portion 8 of the container member 2. The closure member 50 includes a generally tubular sleeve portion 52 located concentrically about and adjacent the container side wall portion 10, a generally disk-shaped top portion 54 connected across the upper end of sleeve portion 52 parallel with and adjacent the top wall portion 12 of the container member, and an annular bead 56 located on the lower end of sleeve portion 52, whereby the closure member 50 is held securely on the enlarged head portion 8. The top portion 54 further includes an arcuate groove 58 arranged for sliding engagement with the projection 16 of the container member and a gripping projection 60. Upon rotation of the closure member 50, the projection 16 slides within the groove, whereby the degree of rotational movement of the closure member on the enlarged head is limited by the length of the groove 58. The sleeve portion 52 further includes a pouring spout 62 having top and bottom triangular-shaped walls 62*a* and a generally rectangular sloping wall 62*b*, which walls define a pouring opening 64.

Figure 3:
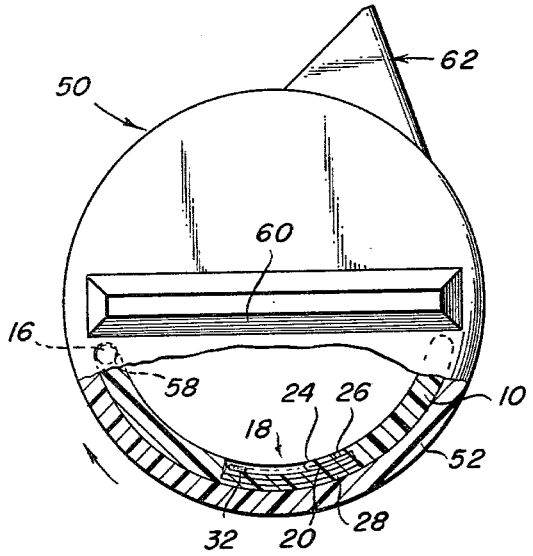
FIG. 3 is a partially broken away top view of the dispensing apparatus of FIG. 2 when in the closed position.
Figure 4:
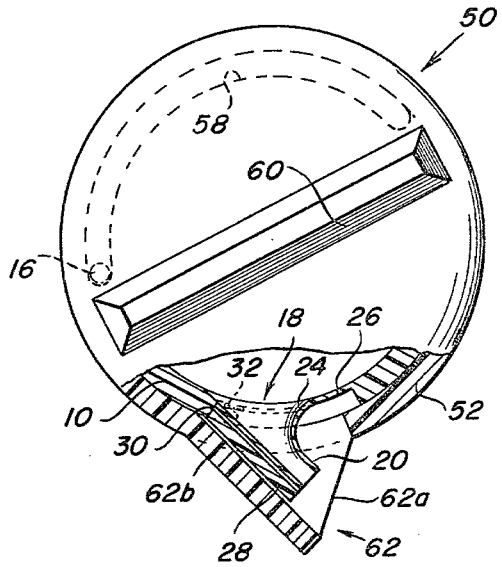
FIG. 4 is a partially broken away top view of the apparatus of FIG. 2 taken along line 4—4.

As shown in FIG. 3, when the closure member is in the closed position, the hinged flap 28 is pressed inwardly against the lip portion 24 by the sleeve portion 52 thereby compressing the flexible pouring spout 20 and sealing off the pouring opening 18 and air vent hold 26. Rotational movement of the closure member in the counter-clockwise direction is limited by the projection 16 which is located in one end of the arcuate groove 58. To dispense the container contents, the closure member 50 is rotated in the clockwise direction to an open position (FIG. 4) until the pouring opening 18 of the container member and the pouring opening 64 of the closure member are aligned, whereby further rotational movement of the closure member in the clockwise direction is limited by the projection 16 which is now located in the other end of the arcuate groove 58. Further rotational movement of the closure member in the clockwise direction would cause the flexible pouring spout 20 and the hinged flap 28 to bend backwards thereby causing breaking or jamming of the dispensing assembly. In the open position, FIG. 4, the flexible pouring spout 20 and the hinged flap 28 are urged into the pouring opening 64 of the closure member 50 by spring means 32 and dispensing of the container contents may be effected. To close the dispensing assembly the closure member 50 is rotated in the counter-clockwise direction to the position shown in FIG. 3.

While the preferred embodiment has been described, it will be understood that modifications and variations may be effected without departing from the spirit and scope of the novel concepts of this invention.

What is claimed is:

1. A synthetic plastic dispensing assembly for a container, comprising (a) a vertically arranged synthetic plastic container member, including:
  (1) a hollow container body portion;
  (2) a generally tubular reduced neck portion connected with the upper end of said body portion; and
  (3) an enlarged head portion connected with the upper end of said neck portion, said head portion including a generally tubular side wall, a generally disk-shaped top wall connected across the upper end of said side wall, and an annular ledge connecting the bottom of the side wall with said neck portion, said head portion further containing a pouring opening in said side wall, an integral flexible pouring spout extending from said opening, integral hinged flap means operable between open and closed positions relative to said pouring opening, and spring means biasing said hinged flap means toward said open position; and (b) a synthetic plastic closure member rotatably mounted on said enlarged head portion, said closure member including
  (1) a generally tubular sleeve portion located concentrically about and adjacent said side wall portion;
  (2) a generally disk-shaped top wall portion connected across the upper end of said sleeve portion and parallel with and adjacent said head portion top wall;
  (3) an internal annular bead located on the lower end of said sleeve portion, said bead being arranged for snap-fit engagement with said annular ledge to hold said closure member securely on said enlarged head portion; and
  (4) an integral stationary pouring spout located on said closure member sleeve portion, said pouring spout containing a pouring opening;

(c) said closure member being rotatable between a closed position in which the hinged flap means is maintained by said sleeve portion in a closed position to maintain said container member pouring spout in a reversely folded closed condition, and an open position in which the hinged flap means is biased by the spring means toward an open position in which the container member pouring spout is unfolded to an open condition and extends with the hinged flap means into said closure member pouring spout.

2. A dispensing assembly as defined in claim 1, wherein said container member pouring spout includes an air vent hole.

3. A dispensing assembly as defined in claim 2, wherein said enlarged head portion and said closure member include groove and projection means for limiting the rotational movement of said closure member on said enlarged head.

4. A dispensing assembly as defined in claim 2, wherein said closure member includes gripping means for rotating said closure member.

5. A dispensing assembly as defined in claim 1, wherein said hinged flap substantially conforms to the curvature of said side wall when said flap is in the closed position, whereby said closure member is freely rotatable thereon.

* * * * *